US009689231B2

(12) United States Patent
Fripp et al.

(10) Patent No.: US 9,689,231 B2
(45) Date of Patent: Jun. 27, 2017

(54) ISOLATION DEVICES HAVING AN ANODE MATRIX AND A FIBER CATHODE

(71) Applicant: HALLIBURTON ENERGY SERVICES, INC., Houston, TX (US)

(72) Inventors: Michael L. Fripp, Carrollton, TX (US); Zachary R. Murphree, Carrollton, TX (US); Zachary W. Walton, Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 203 days.

(21) Appl. No.: 14/254,156

(22) Filed: Apr. 16, 2014

(65) Prior Publication Data

US 2014/0224507 A1 Aug. 14, 2014

Related U.S. Application Data

(63) Continuation-in-part of application No. 13/491,995, filed on Jun. 8, 2012, now Pat. No. 8,905,147, and a continuation-in-part of application No. PCT/US2013/027531, filed on Feb. 23, 2013.

(51) Int. Cl.

| | |
|---|---|
| ***E21B 34/12*** | (2006.01) |
| ***E21B 34/06*** | (2006.01) |
| ***E21B 33/12*** | (2006.01) |

(52) U.S. Cl.

CPC ..... *E21B 34/063* (2013.01); *E21B 33/12* (2013.01)

(58) Field of Classification Search

CPC ..... E21B 29/00

See application file for complete search history.

(56) References Cited

U.S. PATENT DOCUMENTS 3,876,471 A 4/1975 Jones
4,573,517 A * 3/1986 Booth ..... B22D 18/06 164/105
5,570,502 A * 11/1996 Sawtell ..... B22D 17/14 164/97

(Continued)

FOREIGN PATENT DOCUMENTS

CA 2857123 6/2013
CA 2857123 A1 6/2013

(Continued)

OTHER PUBLICATIONS

International Search Report and Written Opinion date mailed Mar. 31, 2015; PCT International Application No. PCT/US2014/068438.

(Continued)

*Primary Examiner* — Jennifer H Gay
*Assistant Examiner* — Steven MacDonald
(74) *Attorney, Agent, or Firm* — McGuireWoods LLP

(57) ABSTRACT

A wellbore isolation device comprises: a first material and a second material, wherein the first material and the second material form a galvanic couple and wherein the first material is the anode and the second material is the cathode of the galvanic couple, and wherein the second material is a fiber or a plurality of fibers. A method of removing the wellbore isolation device comprises: contacting or allowing the wellbore isolation device to come in contact with an electrolyte; and causing or allowing at least a portion of the first material to dissolve.

20 Claims, 3 Drawing Sheets

(56) References Cited

U.S. PATENT DOCUMENTS

| | | | | |
|---|---|---|---|---|
| 5,578,255 | A * | 11/1996 | Okuyama | C04B 35/83 156/62.4 |
| 7,077,200 | B1 | 7/2006 | Adnan et al. | |
| 7,350,582 | B2 | 4/2008 | McKeachnie et al. | |
| 7,699,101 | B2 | 4/2010 | Fripp et al. | |
| 7,708,937 | B2 | 5/2010 | Meng et al. | |
| 7,798,236 | B2 | 9/2010 | McKeachnie et al. | |
| 8,211,248 | B2 | 7/2012 | Marya | |
| 8,413,727 | B2 | 4/2013 | Holmes | |
| 8,424,610 | B2 | 4/2013 | Newton et al. | |
| 8,573,295 | B2 | 11/2013 | Johnson et al. | |
| 2004/0045715 | A1 | 3/2004 | Stoesz et al. | |
| 2005/0205265 | A1 | 9/2005 | Todd et al. | |
| 2007/0089877 | A1 | 4/2007 | Corre et al. | |
| 2007/0107908 | A1 | 5/2007 | Vaidya | |
| 2007/0181224 | A1 | 8/2007 | Marya et al. | |
| 2008/0066924 | A1 | 3/2008 | Xu | |
| 2008/0149351 | A1 | 6/2008 | Marya et al. | |
| 2008/0175744 | A1 | 7/2008 | Motegi et al. | |
| 2008/0249637 | A1 | 10/2008 | Asgari | |
| 2009/0025940 | A1 | 1/2009 | Rytlewski | |
| 2009/0101334 | A1 | 4/2009 | Baser et al. | |
| 2010/0270031 | A1* | 10/2010 | Patel | E21B 33/1208 166/376 |
| 2010/0294510 | A1* | 11/2010 | Holmes | E21B 41/00 166/376 |
| 2011/0132619 | A1 | 6/2011 | Agrawal | |
| 2011/0132621 | A1 | 6/2011 | Agrawal et al. | |
| 2011/0136707 | A1 | 6/2011 | Xu et al. | |
| 2011/0186306 | A1 | 8/2011 | Marya et al. | |
| 2012/0118583 | A1 | 5/2012 | Johnson et al. | |
| 2012/0175109 | A1 | 7/2012 | Richard | |
| 2012/0318513 | A1 | 12/2012 | Mazyar et al. | |
| 2013/0032357 | A1 | 2/2013 | Mazyar et al. | |
| 2013/0081814 | A1 | 4/2013 | Gaudette et al. | |
| 2013/0133897 | A1 | 5/2013 | Baihly et al. | |
| 2013/0146302 | A1* | 6/2013 | Gaudette | E21B 31/002 166/376 |
| 2013/0153236 | A1 | 6/2013 | Bishop | |
| 2013/0206425 | A1 | 8/2013 | Mazyar et al. | |
| 2013/0209175 | A1 | 8/2013 | Keyworth | |
| 2013/0240200 | A1 | 9/2013 | Frazier | |
| 2013/0269932 | A1 | 10/2013 | Dams et al. | |
| 2013/0327540 | A1 | 12/2013 | Hamid et al. | |
| 2013/0333899 | A1 | 12/2013 | Xu | |
| 2014/0027128 | A1 | 1/2014 | Johnson et al. | |
| 2014/0196899 | A1* | 7/2014 | Jordan | C22C 1/0416 166/284 |

FOREIGN PATENT DOCUMENTS

| | | | |
|---|---|---|---|
| EP | 2354436 | A2 | 8/2011 |
| EP | 21188437 | B1 | 3/2012 |
| WO | 2007141465 | A1 | 12/2007 |
| WO | WO 2011017047 | A1 | 2/2011 |
| WO | WO 2012/091984 | A2 | 7/2012 |
| WO | WO 2013019409 | A2 | 2/2013 |
| WO | WO2013089941 | A1 | 6/2013 |

OTHER PUBLICATIONS

International Written Opinion date mailed May 27, 2015; PCT International Application No. PCT/US2015/014981.
International Search Report and Written Opinion date mailed May 19, 2015; PCT International Application No. PCT/US2015/014988.
T.Tanski, Synergy effect of heat and surface treatment on properties of the Mg—Al—Zn cast alloys, Journal of Achievements in Materials and Manufacturing Engineering, Oct. 2012, p. 260-274, vol. 54, Issue 2, Silesian University of Technology, Giliwice, Poland.
Degradable Casing Perforation Ball Sealers and Methods for Use in Well Treatment, IPCOM000215741D, Mar. 7, 2012. Available at: http://priorartdatabase.com/IPCOM/000215741.
Solu-Plugs—Delayed Frac Plugs, IPCOM000176055D, Nov. 3, 2008. Available at: http://www.ip.com/pubview/IPCOM000176055D.
Australian Patent Office, Patent Examination Report No. 1, Australian Application No. 2014377594, Jul. 21, 2016.
Australian Government IP Australia; Patent Examination Report No. 2; Apr. 29, 2016.
Australian Patent Office, Patent Examination Report No. 1, Australian Application No. 2015248171, Sep. 6, 2016.
European Patent Office, Communication, European extended search report, Application No. 13801386.7, May 30, 2016.
European Patent Office, Communication (extended European search report), European Application No. 14878579.3, Apr. 25, 2017.
Canadian Intellectual Property Office, Office Action, Application No. 2,868,885, dated Mar. 15, 2017.
Australian Patent Office, Patent Exam Report No. 2, Australian Application No. 2014377594, Sep. 29, 2016.
European Patent Office, Communication pursuant to Rules 161(2) and 162 EPC, European Application No. 14878579.3, Jun. 3, 2016.
PCT, International Search Report and Written Opinion, PCT Application No. PCT/US2014/068372, Mar. 19, 2015.
Australian Patent Office, Patent Exam Report No. 1, Australian Application No. 2014385212, Jul. 14, 2016.
European Patent Office, Communication pursuant to Rules 161(2) and 162 EPC, European Application No. 14884707.2, Jun. 16, 2016.
Australian Patent Office, Patent Exam Report No. 1, Australian Application No. 2014385213, Aug. 11, 2016.
Australian Patent Office, Patent Exam Report No. 2, Australian Application No. 2014385213, Oct. 12, 2016.
European Patent Office, Communication pursuant to Rules 161(2) and 162 EPC, European Application No. 14884808.8, Jun. 21, 2016.
PCT, International Search Report and Written Opinion, PCT Application No. PCT/US2013/027531, Dec. 9, 2014.
Patent Office of the Cooperation Council for the Arab States of the Gulf, Examination Report, GC Application No. 2013-24222, May 11, 2016.
PCT, International Search Report and Written Opinion, PCT Application No. PCT/US2014/068442, Mar. 19, 2015.
European Patent Office, Communication pursuant to Rules 161(2) and 162 EPC, European Application No. 15780083.0, Oct. 26, 2016.
Canadian Intellectual Property Office, Office Action, Canadian Application No. 2,868,885, Jan. 20, 2016.
Canadian Intellectual Property Office, Office Action, Canadian Application No. 2,868,885, Oct. 27, 2016.
Patent Office of the Cooperation Council for the Arab States of the Gulf, Examination Report, Application No. GC2013-24222, dated Aug. 18, 2016.

* cited by examiner

ISOLATION DEVICES HAVING AN ANODE MATRIX AND A FIBER CATHODE

TECHNICAL FIELD

An isolation device and methods of removing the isolation device are provided. The isolation device includes at least a first material that is capable of dissolving via galvanic corrosion when an electrically conductive path exists between the first material and a cathode in the presence of an electrolyte. The cathode can be fibers. According to an embodiment, the isolation device is used in an oil or gas well operation.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
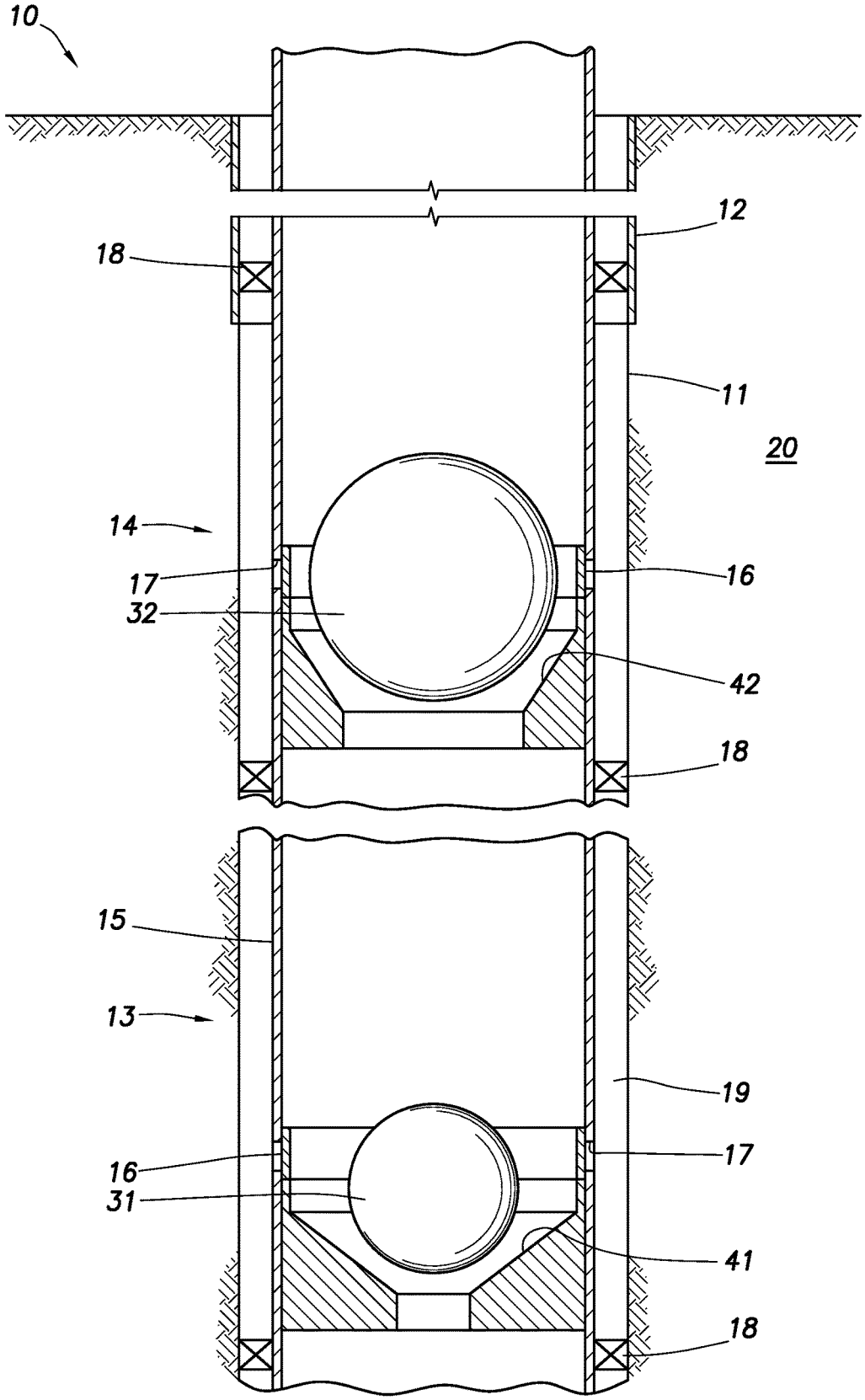
FIG. 1 depicts a well system containing more than one isolation device.

As used herein, the words "comprise," "have," "include," and all grammatical variations thereof are each intended to have an open, non-limiting meaning that does not exclude additional elements or steps.

It should be understood that, as used herein, "first," "second," "third," etc., are arbitrarily assigned and are merely intended to differentiate between two or more materials, isolation devices, wellbore intervals, etc., as the case may be, and does not indicate any particular orientation or sequence. Furthermore, it is to be understood that the mere use of the term "first" does not require that there be any "second," and the mere use of the term "second" does not require that there be any "third," etc.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas.

Oil and gas hydrocarbons are naturally occurring in some subterranean formations. In the oil and gas industry, a subterranean formation containing oil or gas is referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from a reservoir is called a reservoir fluid.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a well" means and includes into any portion of the well, including into the wellbore or into the near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

It is not uncommon for a wellbore to extend several hundreds of feet or several thousands of feet into a subterranean formation. The subterranean formation can have different zones. A zone is an interval of rock differentiated from surrounding rocks on the basis of its fossil content or other features, such as faults or fractures. For example, one zone can have a higher permeability compared to another zone. It is often desirable to treat one or more locations within multiples zones of a formation. One or more zones of the formation can be isolated within the wellbore via the use of an isolation device to create multiple wellbore intervals. At least one wellbore interval corresponds to a formation zone. The isolation device can be used for zonal isolation and functions to block fluid flow within a tubular, such as a tubing string, or within an annulus. The blockage of fluid flow prevents the fluid from flowing across the isolation device in any direction and isolates the zone of interest. In this manner, treatment techniques can be performed within the zone of interest.

Common isolation devices include, but are not limited to, a ball and a seat, a bridge plug, a packer, a plug, and wiper plug. It is to be understood that reference to a "ball" is not meant to limit the geometric shape of the ball to spherical, but rather is meant to include any device that is capable of engaging with a seat. A "ball" can be spherical in shape, but can also be a dart, a bar, or any other shape. Zonal isolation can be accomplished via a ball and seat by dropping or flowing the ball from the wellhead onto the seat that is located within the wellbore. The ball engages with the seat, and the seal created by this engagement prevents fluid communication into other wellbore intervals downstream of the ball and seat. As used herein, the relative term "downstream" means at a location further away from a wellhead. In order to treat more than one zone using a ball and seat, the wellbore can contain more than one ball seat. For example, a seat can be located within each wellbore interval. Generally, the inner diameter (I.D.) of the ball seats is different for each zone. For example, the I.D. of the ball seats sequentially decreases at each zone, moving from the wellhead to the bottom of the well. In this manner, a smaller ball is first dropped into a first wellbore interval that is the farthest downstream; the corresponding zone is treated; a slightly larger ball is then dropped into another wellbore interval that is located upstream of the first wellbore interval; that corresponding zone is then treated; and the process continues in this fashion—moving upstream along the wellbore—until all the desired zones have been treated. As used herein, the relative term "upstream" means at a location closer to the wellhead.

A bridge plug is composed primarily of slips, a plug mandrel, and a rubber sealing element. A bridge plug can be introduced into a wellbore and the sealing element can be caused to block fluid flow into downstream intervals. A packer generally consists of a sealing device, a holding or setting device, and an inside passage for fluids. A packer can be used to block fluid flow through the annulus located between the outside of a tubular and the wall of the wellbore or inside of a casing.

Isolation devices can be classified as permanent or retrievable. While permanent isolation devices are generally designed to remain in the wellbore after use, retrievable devices are capable of being removed after use. It is often desirable to use a retrievable isolation device in order to restore fluid communication between one or more wellbore intervals. Traditionally, isolation devices are retrieved by inserting a retrieval tool into the wellbore, wherein the retrieval tool engages with the isolation device, attaches to the isolation device, and the isolation device is then removed from the wellbore. Another way to remove an isolation device from the wellbore is to mill at least a portion of the device or the entire device. Yet, another way to remove an isolation device is to contact the device with a solvent, such as an acid, thus dissolving all or a portion of the device.

However, some of the disadvantages to using traditional methods to remove a retrievable isolation device include: it can be difficult and time consuming to use a retrieval tool; milling can be time consuming and costly; and premature dissolution of the isolation device can occur. For example, premature dissolution can occur if acidic fluids are used in the well prior to the time at which it is desired to dissolve the isolation device.

A novel method of removing an isolation device includes using galvanic corrosion to dissolve at least a portion of the isolation device. The isolation device includes an anode and fibers of a cathode of a galvanic system. The cathode fibers can help to increase the tensile strength of the portion of the isolation device.

Galvanic corrosion occurs when two different metals or metal alloys are in electrical connectivity with each other and both are in contact with an electrolyte. As used herein, the phrase "electrical connectivity" means that the two different metals or metal alloys are either touching or in close enough proximity to each other such that when the two different metals are in contact with an electrolyte, the electrolyte becomes electrically conductive and ion migration occurs between one of the metals and the other metal, and is not meant to require an actual physical connection between the two different metals, for example, via a metal wire. It is to be understood that as used herein, the term "metal" is meant to include pure metals and also metal alloys without the need to continually specify that the metal can also be a metal alloy. Moreover, the use of the phrase "metal or metal alloy" in one sentence or paragraph does not mean that the mere use of the word "metal" in another sentence or paragraph is meant to exclude a metal alloy. As used herein, the term "metal alloy" means a mixture of two or more elements, wherein at least one of the elements is a metal. The other element(s) can be a non-metal or a different metal. An example of a metal and non-metal alloy is steel, comprising the metal element iron and the non-metal element carbon. An example of a metal and metal alloy is bronze, comprising the metallic elements copper and tin.

The metal that is less noble, compared to the other metal, will dissolve in the electrolyte. The less noble metal is often referred to as the anode, and the more noble metal is often referred to as the cathode. The anode and the cathode can form a galvanic couple. Galvanic corrosion is an electrochemical process whereby free ions in the electrolyte make the electrolyte electrically conductive, thereby providing a means for ion migration from the anode to the cathode—resulting in deposition formed on the cathode. Metals can be arranged in a galvanic series. The galvanic series lists metals in order of the most noble to the least noble. An anodic index lists the electrochemical voltage (V) that develops between a metal and a standard reference electrode (gold (Au)) in a given electrolyte. The actual electrolyte used can affect where a particular metal or metal alloy appears on the galvanic series and can also affect the electrochemical voltage. For example, the dissolved oxygen content in the electrolyte can dictate where the metal or metal alloy appears on the galvanic series and the metal's electrochemical voltage. The anodic index of gold is −0 V; while the anodic index of beryllium is −1.85 V. A metal that has an anodic index greater than another metal is more noble than the other metal and will function as the cathode. Conversely, the metal that has an anodic index less than another metal is less noble and functions as the anode. In order to determine the relative voltage between two different metals, the anodic index of the lesser noble metal is subtracted from the other metal's anodic index, resulting in a positive value.

There are several factors that can affect the rate of galvanic corrosion. One of the factors is the distance separating the metals on the galvanic series chart or the difference between the anodic indices of the metals. For example, beryllium is one of the last metals listed at the least noble end of the galvanic series and platinum is one of the first metals listed at the most noble end of the series. By contrast, tin is listed directly above lead on the galvanic series. Using the anodic index of metals, the difference between the anodic index of gold and beryllium is 1.85 V; whereas, the difference between tin and lead is 0.05 V. This means that galvanic corrosion will occur at a much faster rate for magnesium or beryllium and gold compared to lead and tin.

The following is a partial galvanic series chart using a deoxygenated sodium chloride water solution as the electrolyte. The metals are listed in descending order from the most noble (cathodic) to the least noble (anodic). The following list is not exhaustive, and one of ordinary skill in the art is able to find where a specific metal or metal alloy is listed on a galvanic series in a given electrolyte.

PLATINUM
GOLD
ZIRCONIUM
GRAPHITE
SILVER
CHROME IRON
SILVER SOLDER
COPPER-NICKEL ALLOY 80-20
COPPER-NICKEL ALLOY 90-10
MANGANESE BRONZE (CA 675), TIN BRONZE (CA903, 905)
COPPER (CA102)
BRASSES
NICKEL (ACTIVE)
TIN
LEAD
ALUMINUM BRONZE
STAINLESS STEEL
CHROME IRON

MILD STEEL (1018), WROUGHT IRON
ALUMINUM 2117, 2017, 2024
CADMIUM
ALUMINUM 5052, 3004, 3003, 1100, 6053
ZINC
MAGNESIUM
BERYLLIUM

The following is a partial anodic index listing the voltage of a listed metal against a standard reference electrode (gold) using a deoxygenated sodium chloride water solution as the electrolyte. The metals are listed in descending order from the greatest voltage (most cathodic) to the least voltage (most anodic). The following list is not exhaustive, and one of ordinary skill in the art is able to find the anodic index of a specific metal or metal alloy in a given electrolyte.

Anodic index

| Metal | Index (V) |
|---|---|
| Gold, solid and plated, Gold-platinum alloy | −0.00 |
| Rhodium plated on silver-plated copper | −0.05 |
| Silver, solid or plated; monel metal; high nickel-copper alloys | −0.15 |
| Nickel, solid or plated, titanium and alloys, monel | −0.30 |
| Copper, solid or plated; low brasses or bronzes; silver solder; German silvery high copper-nickel alloys; nickel-chromium alloys | −0.35 |
| Brass and bronzes | −0.40 |
| High brasses and bronzes | −0.45 |
| 18% chromium type corrosion-resistant steels | −0.50 |
| Chromium plated; tin plated; 12% chromium type corrosion-resistant steels | −0.60 |
| Tin-plate; tin-lead solder | −0.65 |
| Lead, solid or plated; high lead alloys | −0.70 |
| 2000 series wrought aluminum | −0.75 |
| Iron, wrought, gray or malleable, plain carbon and low alloy steels | −0.85 |
| Aluminum, wrought alloys other than 2000 series aluminum, cast alloys of the silicon type | −0.90 |
| Aluminum, cast alloys other than silicon type, cadmium, plated and chromate | −0.95 |
| Hot-dip-zinc plate; galvanized steel | −1.20 |
| Zinc, wrought; zinc-base die-casting alloys; zinc plated | −1.25 |
| Magnesium & magnesium-base alloys, cast or wrought | −1.75 |
| Beryllium | −1.85 |

Another factor that can affect the rate of galvanic corrosion is the temperature and concentration of the electrolyte. The higher the temperature and concentration of the electrolyte, the faster the rate of corrosion. Yet another factor that can affect the rate of galvanic corrosion is the total amount of surface area of the least noble (anodic metal). The greater the surface area of the anode that can come in contact with the electrolyte, the faster the rate of corrosion. The cross-sectional size of the anodic metal pieces can be decreased in order to increase the total amount of surface area per total volume of the material. The anodic metal or metal alloy can also be a matrix in which pieces of cathode material is embedded in the anode matrix. Yet another factor that can affect the rate of galvanic corrosion is the ambient pressure. Depending on the electrolyte chemistry and the two metals, the corrosion rate can be slower at higher pressures than at lower pressures if gaseous components are generated. Yet another factor that can affect the rate of galvanic corrosion is the physical distance between the two different metal and/or metal alloys of the galvanic system.

According to an embodiment, a wellbore isolation device comprises: a first material and a second material, wherein the first material and the second material form a galvanic couple and wherein the first material is the anode and the second material is the cathode of the galvanic couple, and wherein the second material is a fiber or a plurality of fibers.

According to another embodiment, a method of removing the wellbore isolation device comprises: contacting or allowing the wellbore isolation device to come in contact with an electrolyte; and causing or allowing at least a portion of the first material to dissolve.

Any discussion of the embodiments regarding the isolation device or any component related to the isolation device (e.g., the electrolyte) is intended to apply to all of the apparatus and method embodiments.

Turning to the Figures, FIG. 1 depicts a well system 10. The well system 10 can include at least one wellbore 11. The wellbore 11 can penetrate a subterranean formation 20. The subterranean formation 20 can be a portion of a reservoir or adjacent to a reservoir. The wellbore 11 can include a casing 12. The wellbore 11 can include only a generally vertical wellbore section or can include only a generally horizontal wellbore section. A tubing string 15 can be installed in the wellbore 11. The well system 10 can comprise at least a first wellbore interval 13 and a second wellbore interval 14. The well system 10 can also include more than two wellbore intervals, for example, the well system 10 can further include a third wellbore interval, a fourth wellbore interval, and so on. At least one wellbore interval can correspond to a zone of the subterranean formation 20. The well system 10 can further include one or more packers 18. The packers 18 can be used in addition to the isolation device to create the wellbore interval and isolate each zone of the subterranean formation 20. The isolation device can be the packers 18. The packers 18 can be used to prevent fluid flow between one or more wellbore intervals (e.g., between the first wellbore interval 13 and the second wellbore interval 14) via an annulus 19. The tubing string 15 can also include one or more ports 17. One or more ports 17 can be located in each wellbore interval. Moreover, not every wellbore interval needs to include one or more ports 17. For example, the first wellbore interval 13 can include one or more ports 17, while the second wellbore interval 14 does not contain a port. In this manner, fluid flow into the annulus 19 for a particular wellbore interval can be selected based on the specific oil or gas operation.

It should be noted that the well system 10 is illustrated in the drawings and is described herein as merely one example of a wide variety of well systems in which the principles of this disclosure can be utilized. It should be clearly understood that the principles of this disclosure are not limited to any of the details of the well system 10, or components thereof, depicted in the drawings or described herein. Furthermore, the well system 10 can include other components not depicted in the drawing. For example, the well system 10 can further include a well screen. By way of another example, cement may be used instead of packers 18 to aid the isolation device in providing zonal isolation. Cement may also be used in addition to packers 18.

According to an embodiment, the isolation device is capable of restricting or preventing fluid flow between a first wellbore interval 13 and a second wellbore interval 14. The first wellbore interval 13 can be located upstream or downstream of the second wellbore interval 14. In this manner, depending on the oil or gas operation, fluid is restricted or prevented from flowing downstream or upstream into the second wellbore interval 14. Examples of isolation devices capable of restricting or preventing fluid flow between zones include, but are not limited to, a ball and seat, a plug, a bridge plug, a wiper plug, a packer, and a plug in a base pipe. A detailed discussion of using a plug in a base pipe can be found in U.S. Pat. No. 7,699,101 issued to Michael L. Fripp, Haoyue Zhang, Luke W. Holderman, Deborah Fripp, Ashok K. Santra, and Anindya Ghosh on Apr. 20, 2010 and is incorporated herein in its entirety for all purposes. If there is any conflict in the usage of a word or phrase herein and any paper incorporated by reference, the definitions contained herein control. The portion of the isolation device that includes at least the first material and the second material can be the mandrel of a packer or plug, a spacer ring, a slip, a wedge, a retainer ring, an extrusion limiter or backup shoe, a mule shoe, a ball, a flapper, a ball seat, a sleeve, or any other downhole tool or component of a downhole tool used for zonal isolation.

As depicted in the drawings, the isolation device can be a ball 30 (e.g., a first ball 31 or a second ball 32) and a seat 40 (e.g., a first seat 41 or a second seat 42). The ball 30 can engage the seat 40. The seat 40 can be located on the inside of a tubing string 15. The inner diameter (I.D.) of the first seat 41 can be less than the I.D. of the second seat 42. In this manner, a first ball 31 can be dropped or flowed into wellbore. The first ball 31 can have a smaller outer diameter (O.D.) than the second ball 32. The first ball 31 can engage the first seat 41. Fluid can now be temporarily restricted or prevented from flowing into any wellbore intervals located downstream of the first wellbore interval 13. In the event it is desirable to temporarily restrict or prevent fluid flow into any wellbore intervals located downstream of the second wellbore interval 14, then the second ball 32 can be dropped or flowed into the wellbore and will be prevented from falling past the second seat 42 because the second ball 32 has a larger O.D. than the I.D. of the second seat 42. The second ball 32 can engage the second seat 42. The ball (whether it be a first ball 31 or a second ball 32) can engage a sliding sleeve 16 during placement. This engagement with the sliding sleeve 16 can cause the sliding sleeve to move; thus, opening a port 17 located adjacent to the seat. The port 17 can also be opened via a variety of other mechanisms instead of a ball. The use of other mechanisms may be advantageous when the isolation device is not a ball. After placement of the isolation device, fluid can be flowed from, or into, the subterranean formation 20 via one or more opened ports 17 located within a particular wellbore interval. As such, a fluid can be produced from the subterranean formation 20 or injected into the formation.

The methods include contacting or allowing the wellbore isolation device to come in contact with an electrolyte. As used herein, an electrolyte is any substance containing free ions (i.e., a positive- or negative-electrically charged atom or group of atoms) that make the substance electrically conductive. The electrolyte can be selected from the group consisting of, solutions of an acid, a base, a salt, and combinations thereof. A salt can be dissolved in water, for example, to create a salt solution. Common free ions in an electrolyte include sodium ($Na^+$), potassium ($K^+$), calcium ($Ca^{2+}$), magnesium ($Mg^{2+}$), chloride ($Cl^-$), hydrogen phosphate ($HPO_4^{2-}$), and hydrogen carbonate ($HCO_3^-$). The methods can include contacting or allowing the device to come in contact with two or more electrolytes. If more than one electrolyte is used, the free ions in each electrolyte can be the same or different. A first electrolyte can be, for example, a stronger electrolyte compared to a second electrolyte. Furthermore, the concentration of each electrolyte can be the same or different. It is to be understood that when discussing the concentration of an electrolyte, it is meant to be a concentration prior to contact with either the first and second materials 51/52, as the concentration will decrease during the galvanic corrosion reaction.

The concentration (i.e., the total number of free ions available in the electrolyte) of the electrolyte can be adjusted to control the rate of dissolution of the first material 51. According to an embodiment, the concentration of the electrolyte is selected such that the at least a portion of the first material 51 dissolves in a desired amount of time. If more than one electrolyte is used, then the concentration of the electrolytes is selected such that the first material 51 dissolves in the desired amount of time. The concentration can be determined based on at least the specific metals or metal alloys selected for the first and second materials 51/52 and the bottomhole temperature of the well. Moreover, because the free ions in the electrolyte enable the electrochemical reaction to occur between the first and second materials 51/52 by donating its free ions, the number of free ions will decrease as the reaction occurs. At some point, the electrolyte may be depleted of free ions if there is any remaining first and second materials 51/52 that have not reacted. If this occurs, the galvanic corrosion that causes the first material 51 to dissolve will stop. In this example, it may be necessary to cause or allow the first and second materials to come in contact with a second, third, or fourth, and so on, electrolyte.

The step of causing can include introducing the electrolyte into the wellbore. The step of allowing can include allowing a reservoir fluid to come in contact with the isolation device, wherein the reservoir fluid is the electrolyte.

Figure 2:
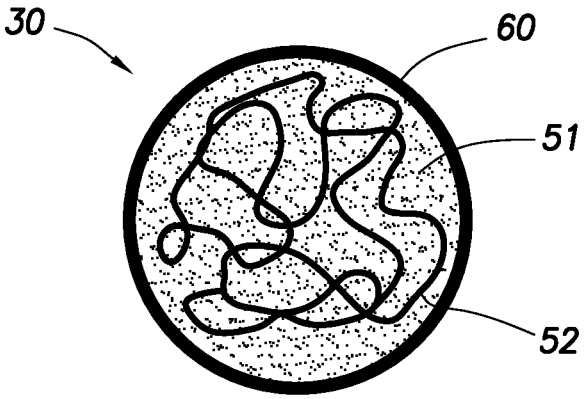
FIG. 2 depicts an isolation device having one continuous cathode fiber.
Figure 3:
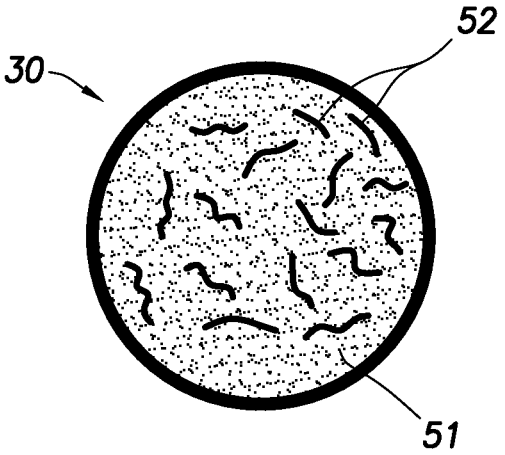
FIG. 3 depicts an isolation device having a plurality of cathode fibers.

Referring to FIGS. 2 and 3, the isolation device comprises a first material 51 and a second material 52. It is to be understood that the entire isolation device, for example, when the isolation device is a ball or ball seat, can be made of at least the first material and second material. Moreover, only one or more portions of the isolation device can be made from at least the first and second materials. The first material 51 and the second material 52 are metals or metal alloys. The metal or metal of the metal alloy can be selected from the group consisting of, lithium, sodium, potassium, rubidium, cesium, beryllium, calcium, strontium, barium, radium, aluminum, gallium, indium, tin, thallium, lead, bismuth, scandium, titanium, vanadium, chromium, manganese, thorium, iron, cobalt, nickel, copper, zinc, yttrium, zirconium, niobium, molybdenum, ruthenium, rhodium, palladium, praseodymium, silver, cadmium, lanthanum, hafnium, tantalum, tungsten, terbium, rhenium, osmium, iridium, platinum, gold, neodymium, gadolinium, erbium, oxides of any of the foregoing, graphite, carbon, silicon, boron nitride, and any combinations thereof. Preferably, the metal or metal of the metal alloy is selected from the group consisting of magnesium, aluminum, zinc, beryllium, tin, iron, nickel, copper, oxides of any of the foregoing, and combinations thereof. According to an embodiment, the metal is neither radioactive, nor unstable. For a metal alloy, the non-metal can be selected from the group consisting of graphite, carbon, silicon, boron nitride, and combinations thereof.

According to an embodiment, the first material 51 and the second material 52 are different metals or metal alloys. By way of example, the first material 51 can be magnesium and the second material 52 can be iron. Furthermore, the first material 51 can be a metal and the second material 52 can be a metal alloy. The first material and the second material can both be a metal, or the first and second material can both be a metal alloy. The first material and the second material form a galvanic couple and wherein the first material is the anode and the second material is the cathode of the couple. Stated another way, the second material 52 is more noble than the first material 51. In this manner, the first material 51 (acting as the anode) partially or wholly dissolves when in electrical connectivity with the second material 52 and when the first and second materials are in contact with the electrolyte.

The second material is a fiber (as shown in FIG. 2) or a plurality of fibers (as shown in FIG. 3). As used herein, the term "fiber" and all grammatical variations thereof means a solid that is characterized by having a high aspect ratio of length to diameter. For example, a fiber can have an aspect ratio of length to diameter from greater than about 2:1 to about 5,000:1. According to an embodiment, the second material 52 fiber is made of stainless steel, iron, graphite, carbon, magnesium, aluminum, tin, tungsten, nickel, carbon steel, zinc, manganese, copper, silicon, calcium, cobalt, tantalum, rhenium, chromium, silver, gold, platinum, chrome, lead, chrome iron, wrought iron, cadmium, titanium, monel, cast iron, indium, and palladium. Preferably, the second material 52 fiber is a graphite fiber, a carbon fiber, a silicon carbide fiber, or a boron fiber. The fiber can be a nanotube. For example, the fiber can be a carbon nanotube, a titanium oxide nanotube, or combinations of a carbon nanotube with either, aluminum, copper, magnesium, nickel, titanium, or tin. As can be seen in FIG. 2, the fiber can be a continuous fiber that is distributed and wound throughout the matrix of the first material 51. The distribution pattern can be selected to achieve a desired concentration of the cathode second material 52 to the anode first material 51. According to an embodiment, the concentration of anode first material 51 is greater than the concentration of the cathode second material 52.

The fiber can also be woven. A woven fiber can increase the overall strength of the portion of the isolation device. The type of weave can also be selected to achieve a desired strength of the portion of the isolation device, especially depending on the exact metal and/or metal alloys making up the first and second materials 51/52.

Figure 4:
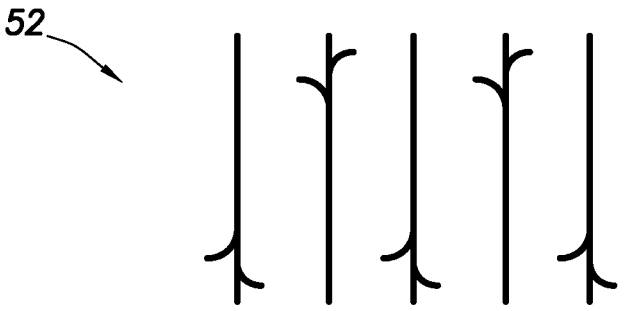
FIGS. 4-6 depict different types of fibrillated fibers.
Figure 5:
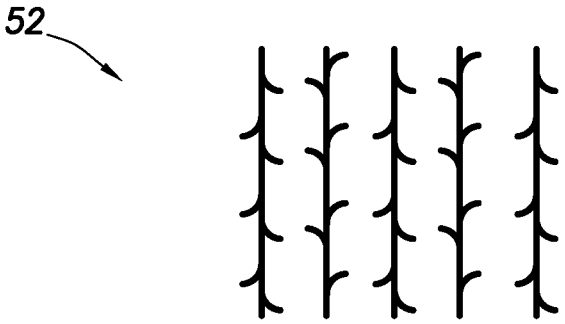
Figure 6:
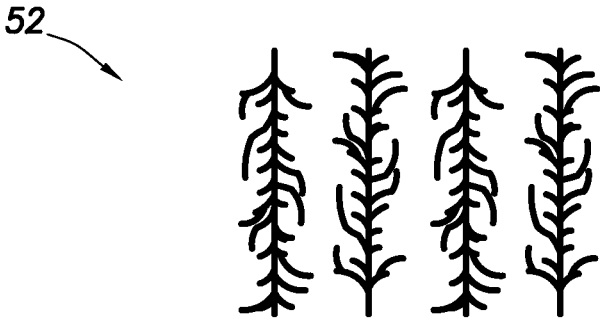

As can be seen in FIG. 3, the second material 52 can be a plurality of fibers. The fibers can be discrete fibers (i.e., a non-continuous strand of fiber). It is to be understood that some of the discrete fibers can be in physical contact with other discrete fibers. The fibers can have a length in the range of about 6 to about 25 millimeters (mm). Preferably, the fibers have a length less than about 6 mm, more preferably in the range of about 3 mm to less than about 6 mm. Some or all of the plurality of fibers can be fibrillated fibers. This embodiment can be useful to increase the overall surface area of the cathode second material 52. As used herein, the term "fibrillated fibers" and all grammatical variations thereof means fibers bearing sliver-like fibrils along the length of the fiber. The fibrils extend from the fiber, often referred to as the "core fiber," and have a diameter significantly less that the core fiber from which the fibrils extend. Fibrillated fibers are commonly used in the papermaking industry and can be produced in a variety of ways, including a wet-spun water-dispersed form or a dry form. The fibrils can be in a split (shown in FIG. 4), barbed (shown in FIG. 5), or pulped (shown in FIG. 6) pattern.

At least a portion of the first material 51 can dissolve in a desired amount of time. The desired amount of time can be pre-determined, based in part, on the specific oil or gas well operation to be performed. The desired amount of time can be in the range from about 1 hour to about 2 months, preferably about 5 to about 10 days. According to an embodiment, at least the first material 51 includes one or more tracers (not shown). The tracer(s) can be, without limitation, radioactive, chemical, electronic, or acoustic. As depicted in FIG. 3, each piece of the first material 51 can include a tracer. A tracer can be useful in determining real-time information on the rate of dissolution of the first material 51. For example, a first material 51 containing a tracer, upon dissolution can be flowed through the wellbore 11 and towards the wellhead or into the subterranean formation 20. By being able to monitor the presence of the tracer, workers at the surface can make on-the-fly decisions that can affect the rate of dissolution of the remaining first material 51. Such decisions might include increasing or decreasing the concentration of the electrolyte.

There are several factors that can affect the rate of dissolution of the first material 51. According to an embodiment, the first material 51 and the second material 52 are selected such that the at least a portion of the first material 51 dissolves in the desired amount of time. By way of example, the greater the difference between the second material's anodic index and the first material's anodic index, the faster the rate of dissolution. By contrast, the less the difference between the second material's anodic index and the first material's anodic index, the slower the rate of dissolution. By evaluating the difference in the anodic index of the first and second materials one of ordinary skill in the art will be able to determine the rate of dissolution of the first material in a given electrolyte.

Another factor that can affect the rate of dissolution of the first material 51 is the proximity and concentration of the first material 51 to the second material 52. The exact number or concentration of the second material 52 can be selected and adjusted to control the dissolution rate of the first material 51 such that at least the portion of the first material 51 dissolves in the desired amount of time. For example, the higher the concentration of the second material 52 that is distributed or woven throughout the matrix of the first material 51, generally the faster the rate of dissolution. Moreover, the distribution pattern of the second material 52 can be uniformly distributed throughout the matrix of the first material 51. This embodiment can be useful when a constant rate of dissolution of the first material is desired. The distribution pattern of the second material can also be non-uniformly distributed throughout the matrix of the first material such that different concentrations of the second material are located within different areas of the matrix. By way of example, a higher concentration of the fibers of the second material can be distributed closer to the outside of the matrix for allowing an initially faster rate of dissolution; whereas a lower concentration of the fibers can be distributed in the middle and inside of the matrix for allowing a slower rate of dissolution. Of course the concentration of the second material can be distributed in a variety of ways to allow for differing rates of dissolution of the first material.

Another factor that can affect the rate of dissolution of the first material 51 is the concentration of the electrolyte and the temperature of the electrolyte. Generally, the higher the concentration of the electrolyte, the faster the rate of dissolution of the first material 51, and the lower the concentration of the electrolyte, the slower the rate of dissolution. Moreover, the higher the temperature of the electrolyte, the faster the rate of dissolution of the first material 51, and the lower the temperature of the electrolyte, the slower the rate of dissolution. One of ordinary skill in the art can select: the exact metals and/or metal alloys, the proximity of the first and second materials, and the concentration of the electrolyte based on an anticipated temperature in order for the at least a portion of the first material 51 to dissolve in the desired amount of time.

According to an embodiment, a third material is included in the portion of the isolation device (not shown). The third material can be a bonding agent for bonding the fiber or plurality of fibers of the second material 52 into the matrix of the first material 51. This embodiment can be useful during the manufacturing process to provide a suitable bond between the matrix of the first material 51 and fiber(s) of the second material 52. Examples of materials suitable for use as a bonding third material include, but are not limited to, copper, platinum, gold, silver, nickel, iron, chromium, molybdenum, tungsten, stainless steel, zirconium, titanium, indium, and oxides of any of the foregoing. Preferably, the third material includes a metal and/or a non-metal that is different from the metals making up the first and second materials 51/52. It may be desirable to use the oxide of the metal to create a better bond between the first and second materials 51/52. The third material can be coated onto the fiber(s) of the second material 52. The thickness of the layer of the third material can be selected to provide the desired bond strength between the second material 52 and the first material 51. For example, if the layer is too thin, then there may be an insufficient amount of third material to create a good bond, and if the layer is too thick, then the layer may become mechanically weak and mechanical failure can occur at the interface between the third material and the first or second materials or failure could also occur within the layer of third material. Preferably, the thickness of the layer of third material is in the range of about 10 nanometers to about 100 nanometers. In another embodiment, the thickness of the third material is less than 10 nanometers. In another embodiment, the thickness of the third material is 100 nanometers to 5,000 nanometers.

According to an embodiment, at least the first material 51 and second material 52 are capable of withstanding a specific pressure differential for a desired amount of time. As used herein, the term "withstanding" means that the substance does not crack, break, or collapse. The pressure differential can be the downhole pressure of the subterranean formation 20 across the device. As used herein, the term "downhole" means the location of the wellbore where the portion of the isolation device is located. Formation pressures can range from about 1,000 to about 30,000 pounds force per square inch (psi) (about 6.9 to about 206.8 megapascals "MPa"). The pressure differential can also be created during oil or gas operations. For example, a fluid, when introduced into the wellbore 11 upstream or downstream of the substance, can create a higher pressure above or below, respectively, of the isolation device. Pressure differentials can range from 100 to over 10,000 psi (about 0.7 to over 68.9 MPa). According to another embodiment, the isolation device is capable of withstanding the specific pressure differential for the desired amount of time. The desired amount of time can be at least 30 minutes. The desired amount of time can also be in the range of about 30 minutes to 14 days, preferably 30 minutes to 2 days, more preferably 4 hours to 24 hours. The inclusion of aluminum, zinc, zirconium, and/or thorium can promote precipitation hardening and strengthen the metal alloy Inclusion of zirconium, neodymium, gadolinium, scandium, erbium, thorium, and/or yttrium increases the dimensional stability and creep resistance of the matrix of the first material 51 especially at higher temperatures. Silicon can reduce the creep resistance because the silicon forms fine, hard particles of $Mg_2Si$ along the grain boundaries of the matrix of the first material 51 and the fiber(s) of the second material 52, which helps to retard the grain-boundary sliding.

According to an embodiment, the portion of the isolation device has a desired density. The inclusion of lithium can reduce the density of the portion of the isolation device.

The portion of the isolation device can be manufactured by a variety of processes, including, but not limited to, powder metallurgy (powder blending and consolidation), stir casting, electroplating and electroforming, spray deposition, semi-solid powder processing, or physical vapor deposition.

The methods include causing or allowing at least a portion of the first material to dissolve. The step of causing or allowing can be performed after the step of contacting or allowing the first material to come in contact with the electrolyte. It may be desirable to delay contact of the first and second materials 51/52 with the electrolyte. The portion of the isolation device can further include a coating 60 on the outside of the device. The coating can be a compound, such as a wax, thermoplastic, sugar, salt, or a conducting polymer and can include chromates, phosphates, and polyanilines. The coating can be selected such that the coating dissolves in wellbore fluids, melts at a certain temperatures, or cracks and falls away. Upon dissolution, melting, or cracking at least the first material 51 of the isolation device is available to come in contact with the electrolyte. The coating 60 can also be porous to allow the electrolyte to come in contact with some of the first and second materials 51/52.

The methods can further include the step of placing the isolation device in a portion of the wellbore 11, wherein the step of placing is performed prior to the step of contacting or allowing the isolation device to come in contact with the electrolyte. More than one isolation device can also be placed in multiple portions of the wellbore. The methods can further include the step of removing all or a portion of the dissolved first material 51 and/or all or a portion of the second material 52 or the coating 60, wherein the step of removing is performed after the step of allowing the at least a portion of the first material to dissolve. The step of removing can include flowing the dissolved first material 51 and/or the second material 52 or coating 60 from the wellbore 11. According to an embodiment, a sufficient amount of the first material 51 dissolves such that the isolation device is capable of being flowed from the wellbore 11. According to this embodiment, the isolation device should be capable of being flowed from the wellbore via dissolution of the first material 51, without the use of a milling apparatus, retrieval apparatus, or other such apparatus commonly used to remove isolation devices.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of removing a wellbore isolation device comprising:

contacting or allowing the wellbore isolation device to come in contact with an electrolyte, wherein at least a portion of the wellbore isolation device comprises a first material, a second material and a third material, wherein the first material comprises magnesium, and the third material provides a bond between the first material and the second material, and the third material is selected from the group comprising: copper, platinum, gold, silver, nickel, iron, chromium, molybdenum, tungsten, stainless steel, zirconium, titanium, indium, and an oxide of any thereof;

wherein the first material and the second material form a galvanic couple and wherein the first material is the anode and the second material is the cathode of the galvanic couple, and wherein the second material is a fiber or a plurality of fibers; and causing or allowing at least a portion of the first material to dissolve.

2. The method according to claim 1, wherein the isolation device is capable of restricting or preventing fluid flow between a first wellbore interval and a second wellbore interval.

3. The method according to claim 1, wherein isolation device is a ball, a ball seat, a plug, a bridge plug, a wiper plug, a packer, or a plug for a base pipe.

4. The method according to claim 1, wherein the portion of the isolation device is the mandrel of a packer or plug, a spacer ring, a slip, a wedge, a retainer ring, an extrusion limiter or backup shoe, a mule shoe, a ball, a flapper, a ball seat, a sleeve, or any other downhole tool or component of a downhole tool used for zonal isolation.

5. The method according to claim 1, wherein the first material is made from a metal or metal alloy, and wherein the metal or metal of the metal alloy is selected from the group consisting of magnesium, zinc, beryllium, tin, iron, nickel, copper, titanium, oxides of any of the foregoing, and combinations thereof, and the second material is selected from the group consisting of magnesium, aluminum, zinc, beryllium, tin, iron, nickel, copper, titanium, oxides of any of the foregoing, and combinations thereof.

6. The method according to claim 1, wherein the fiber or plurality of fibers are selected from the group consisting of a graphite fiber, a carbon fiber, a silicon carbide fiber, a boron fiber, or combinations thereof in any proportion.

7. The method according to claim 6, wherein the fiber is a nanotube.

8. The method according to claim 1, wherein the fiber is a continuous fiber that is distributed and wound throughout a matrix of the first material.

9. The method according to claim 1, wherein the fiber is woven.

10. The method according to claim 1, wherein the fibers have a length in the range of about 3 millimeters to less than about 6 millimeters.

11. The method according to claim 1, wherein some or all of the plurality of fibers are fibrillated fibers.

12. The method according to claim 1, wherein at least the portion of the first material dissolves in a desired amount of time.

13. The method according to claim 12, wherein the concentration of the second material is selected to control the dissolution rate of the first material such that at least the portion of the first material dissolves in the desired amount of time.

14. The method according to claim 1, wherein the fiber or plurality of fibers are uniformly distributed throughout the first material.

15. The method according to claim 1, wherein the fiber or plurality of fibers are non-uniformly distributed throughout the first material such that different concentrations of the second material are located within different areas of the first material.

16. The method according to claim 1, further comprising the step of placing the isolation device into a portion of the wellbore, wherein the step of placing is performed prior to the step of contacting or allowing the isolation device to come in contact with the electrolyte.

17. The method of claim 1, wherein the second material is a woven fiber or a plurality of woven fibers.

18. A wellbore isolation device comprising:

a first material, a second material, and a third material that provides a bond between the first material and the second material, wherein the first material and the second material form a galvanic couple and wherein the first material is the anode and the second material is the cathode of the galvanic couple, wherein the first material comprises magnesium, and wherein the second material is a woven fiber or a plurality of woven fibers, and wherein the third material is selected from the group comprising: copper, platinum, gold, silver, nickel, iron, chromium, molybdenum, tungsten, stainless steel, zirconium, titanium, indium, and an oxide of any thereof.

19. The isolation device according to claim 18, wherein the woven fiber or plurality of woven fibers are selected from the group consisting of a graphite fiber, a carbon fiber, a silicon carbide fiber, a boron fiber, or combinations thereof in any proportion.

20. The isolation device according to claim 19, wherein the carbon fiber is a carbon nanotube.

* * * * *